United States Patent [19]

Levine

[11] Patent Number: 4,592,141

[45] Date of Patent: Jun. 3, 1986

[54] SELF-SHARPENING CUTTING IMPLEMENT AND METHOD OF MAKING THE SAME

[76] Inventor: Sol Levine, Van Buren Rd., Morristown, N.J. 07960

[21] Appl. No.: 547,046

[22] Filed: Oct. 31, 1983

[51] Int. Cl.[4] ..... B25F 3/00

[52] U.S. Cl. ..... 30/138; 30/350; 51/295

[58] Field of Search ..... 30/138, 194, 196, 350; 125/15; 51/295

[56] References Cited

U.S. PATENT DOCUMENTS 2,420,650 5/1947 Burch ..... 30/138

4,409,004 10/1983 Sarin et al. ..... 51/295

*Primary Examiner*—Douglas D. Watts

*Attorney, Agent, or Firm*—Kirschstein, Kirschstein, Ottinger & Israel

[57] ABSTRACT

A self-sharpening cutting implement, especially scissors, includes two cutting elements which have respective gripping and cutting portions and which are pivotably connected to one another intermediate the gripping and cutting portions for movement relative to one another along a common plane. Each of the cutting portions has a cutting edge and an adjacent planar surface which is situated in the common plane. A layer of abrasive material is applied to one of the planar adjacent surfaces so that, as the cutting edge of the other of the cutting elements slides along this layer, it is sharpened. The layer may be applied by spraying, plating, vapor deposition, vacuum metallizing, sintering, or adhering the abrasive material to the respective planar adjacent surface.

1 Claim, 3 Drawing Figures

FIG. 1
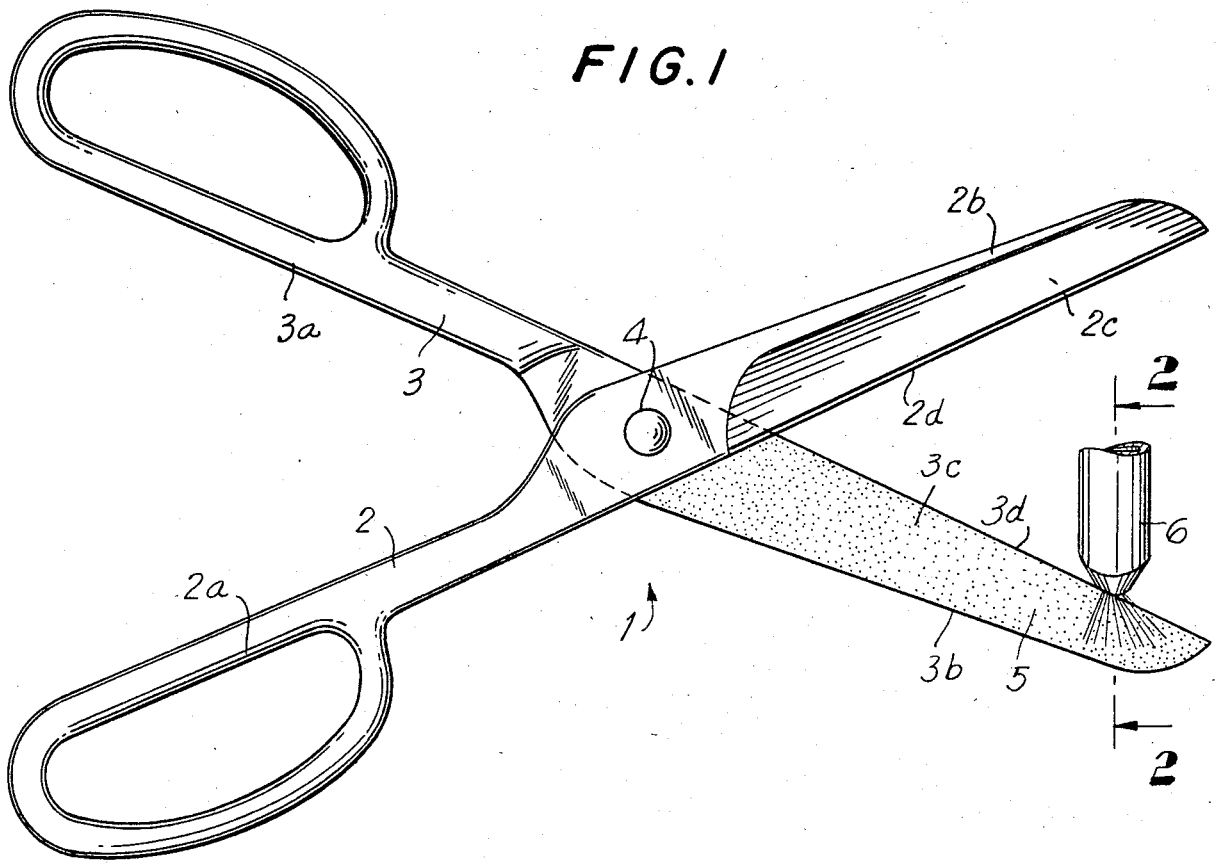
FIG. 2
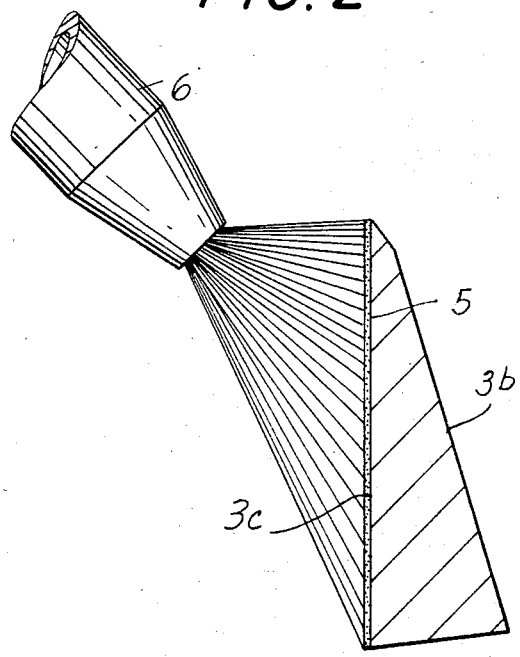
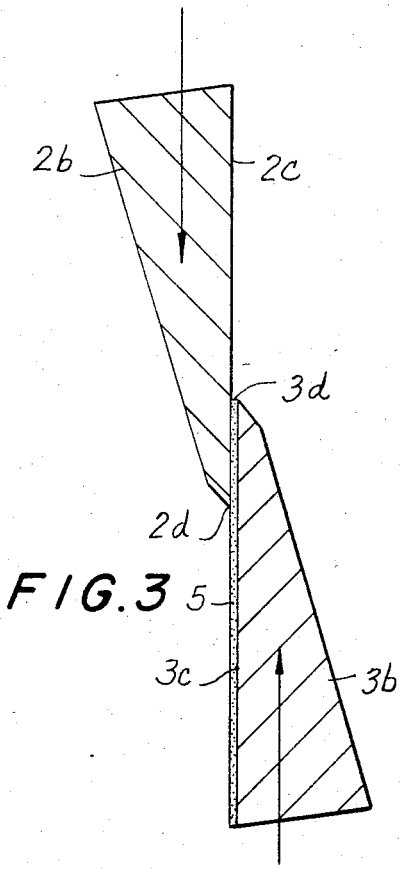
FIG. 3

SELF-SHARPENING CUTTING IMPLEMENT AND METHOD OF MAKING THE SAME

BACKGROUND OF THE INVENTION

The present invention relates to a self-sharpening cutting implement in general, and more particularly to self-sharpening scissors, as well as to a method of making the same.

It has already been previously proposed to make various cutting implements self-sharpening either during their use, or thereafter, or in a separate sharpening operation using permanently installed or replaceable parts of the cutting implement. So, for instance, it is known from the U.S. Pat. No. 2,420,650 to mount abrasive elements in longitudinally extending recesses provided in the cutting blades of shears. This arrangement is disadvantageous in that the separate abrasive elements have to be very precisely aligned and, moreover, are likely to be lost during the use of the cutting element. It is also known from the U.S. Pat. No. 2,791,831 to provide separate abrasive elements in the handle of a jacket knife so that the cutting blade of the knife is sharpened every time it is returned into the handle. Here again, the same disadvantages as discussed above obtain. Finally, the U.S. Pat. No. 1,228,642 discloses a mower in which the cutting blade can be sharpened as it conducts a reciprocatory movement by contacting a separate abrasive element. Even this arrangement has the above-mentioned disadvantages.

SUMMARY OF THE INVENTION

Accordingly, it is a general object of the present invention to avoid the disadvantages of the prior art.

More particularly, it is an object of the present invention to provide a cutting element which does not possess the disadvantages of the conventional cutting implements of this kind.

Still another object of the present invention is so to design the cutting implement as to be simple in construction, inexpensive to manufacture, easy to use, and have reliable self-sharpening properties nevertheless.

A concomitant object of the present invention is to devise a method of making the cutting implement self-sharpening, which method is easy to perform and achieves reliable results.

In pursuance of these objects and others which will become apparent hereafter, one feature of the present invention resides in a self-sharpening cutting implement which comprises a pair of elongated cutting elements each having a gripping portion and a cutting portion, each of the cutting portions having a cutting edge and a substantially planar adjacent surface; means for so connecting the cutting elements to one another intermediate the cutting and gripping portions that the planar adjacent surfaces extend along a common plane and the cutting elements perform a pivoting movement about the connecting means along the aforementioned plane with each of the cutting edges contacting the planar adjacent surface of the respectively other of the cutting elements at least in a part of the trajectory of pivotal movement thereof; and a layer of abrasive material applied at least to one of the planar adjacent surfaces and operative for sharpening the cutting edge of the respectively other of the cutting elements during the movement thereof in the aforementioned part of the trajectory of movement thereof. A particular advantage of this construction of the cutting implement is that the layer need not be precisely aligned since it is applied to a surface that is already in the proper position relative to the cutting edge due to the construction of the cutting element and the operation of the connecting means, and that it can only be worn off but never lost since it constitutes an integral part of the respective cutting element. Moreover, the layer can be reapplied time and time again in a relatively simple manner not requiring any extraordinary skills.

The abrasive layer can be constituted by various materials, such as a plated abrasive material, sprayed abrasive material, vapor deposited abrasive material, vacuum metallized abrasive material, sintered abrasive material, or an adhered abrasive material, such as a mixture of settable organic binder and particulate abrasive material, such as grit.

According to another aspect of the present invention, there is provided a method of making a cutting implement, which includes two elongated elements that are movable relative to one another in a predetermined trajectory and have planar surfaces extending along a common plane and at least one being delimited by a cutting edge, self-sharpening, this method comprising the step of applying a layer of an abrasive material at least to the other of the planar surfaces for sharpening the cutting edge during the movement in the aforementioned trajectory as the cutting edge is in contact with the abrasive material layer. The applying step can include spraying the abrasive material onto the planar surface, plating the abrasive material onto the planar surface, vapor depositing the abrasive material onto the planar surface, vacuum metallizing the abrasive material onto the planar surface, sintering the abrasive material onto the planar surface, adhering an adhesive substance having abrasive properties to the planar surface, or adhering an adhesive substance having abrasive particles interspersed therein to the planar surface.

The novel features which are considered as characteristic of the invention are set forth in particular in the appended claims. The improved cutting implement, especially scissors, itself, both as to its construction and as to its method of manufacture, together with additional features and advantages thereof, will be best understood upon perusal of the following detailed description of certain specific embodiments with reference to the accompanying drawing.

BRIEF DESCRIPTION OF THE DRAWING

FIG. 1 is a side elevational view of self-sharpening scissors made in accordance with the present invention;

FIG. 2 is an enlarged sectional view taken along the line 2—2 of FIG. 1 during a spraying operation; and FIG. 3 is a view similar to that of FIG. 2 but taken during the cutting operation.

DETAILED DESCRIPTION OF THE PREFERRED EMBODIMENT

Referring now to the drawing in detail, and first to FIG. 1 thereof, it may be seen that the reference numeral 1 has been used therein to identify a cutting implement of the present invention, which has been shown to have the configuration of scissors, in its entirety. As customary, the scissors 1 includes two cutting elements 2 and 3 which are connected to one another by a pivot or hinge 4 for pivoting along a common plane extending parallel to the plane of the drawing. The cutting elements 2 and 3 have respective gripping portions 2*a* and 3*a* configurated, as usual, as eyelets, and respective cutting portions 2*b* and 3*b* which have respective planar surfaces 2*c* and 3*c* extending in the aforementioned plane and delimited by respective cutting edges 2*d* and 3*d*.

According to the present invention, a layer 5 of an abrasive material is applied to the planar surface 3*c* of the cutting portion 3*b*. As shown in FIG. 1, and in even more detail in FIG. 2, the layer 5 is applied by a spraying nozzle 6 that is aimed at the planar surface 3*c* during the spraying operation. The spraying operation is performed in a conventional manner and using conventional materials, either at room temperature or at elevated temperatures. However, instead of using the illustrated spraying technique, the abrasive layer 5 can also be applied by using other known techniques, such as by plating, vacuum metallizing, vapor deposition, sintering, or by adhering the layer 5 to the surface 3*c*, using an abrasive adhesive substance, especially a binder having particulate abrasive material interspersed and embedded therein, such as a settable mixture of epoxy and grit.

Once the abrasive layer 5 has been applied to the planar surface 3*c* and has become a permanent integral part of the cutting portion 3*b*, such as by cooling, setting or otherwise hardening, it is possible to use the scissors 1 for cutting. During the cutting operation, as shown in FIG. 3, the cutting edge 2*d* of the cutting portion 2*b* slides along the abrasive layer 5 during at least a part of the pivoting movement of the cutting portion 2*b* relative to the cutting portion 3*b*, as the planar surfaces 2*c* and 3*c* are situated in a common plane. The contact of the cutting edge 2*d* with the abrasive layer 5, on the other hand, sharpens the cutting edge 2*d* by removing excess material thereof. On the other hand, this contact also hardens the material of the cutting portion 2*b* at the region of the cutting edge 2*d*, so that the tendency of the cutting edge 2*d* to become dull during its contact with the material being shorn or severed is counteracted and thus the time period of sharpness of the cutting edge 2*d* is effectively extended.

It will be undestood that each of the elements described above, or two or more together, may also find a useful application in other types of arrangements differing from the type described above, such as in shears, pocket knives, mowers and other cutting implements or the like.

While the invention has been illustrated and described as embodied in self-sharpening scissors, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A self-sharpening cutting implement, comprising:

a pair of elongated cutting elements each having a gripping portion and a cutting portion, each of said cutting portions having a cutting edge and a substantially planar adjacent surface;

means for so connecting said cutting elements to one another intermediate said gripping and cutting portions thereof for pivoting movement relative to one another about said connecting means and along a common plane that said planar adjacent surfaces extend in said common plane and each of the cutting edges contacts said planar adjacent surface of the respectively other of said cutting element at least in a part of the trajectory of relative pivotal movement thereof; and a film-like honing layer constituted of a settable mixture of epoxy and grit, said honing layer being adhered on one of said planar adjacent surfaces and constituting an integral and a permanent portion of said one planar adjacent surface, said honing layer extending from said cutting edge of said one planar adjacent surface and co-extensive therewith along said common plane across said cutting element having said one planar adjacent surface, said honing layer being operative for abrading and sharpening said cutting edge of the respectively other of said cutting elements during the movement thereof in said part of said trajectory.

* * * * *